US009797666B2

(12) United States Patent
Schuetz

(10) Patent No.: US 9,797,666 B2
(45) Date of Patent: Oct. 24, 2017

(54) CONVERTIBLE LOWER RECEIVER

(71) Applicant: Brian D Schuetz, Tumwater, WA (US)

(72) Inventor: Brian D Schuetz, Tumwater, WA (US)

(73) Assignee: Olympic Arms, Inc., Olympia, WA (US)

( * ) Notice: Subject to any disclaimer, the term of this patent is extended or adjusted under 35 U.S.C. 154(b) by 0 days.

(21) Appl. No.: 15/002,352

(22) Filed: Jan. 20, 2016

(65) Prior Publication Data

US 2016/0209136 A1 Jul. 21, 2016

Related U.S. Application Data

(60) Provisional application No. 62/105,451, filed on Jan. 20, 2015.

(51) Int. Cl.
*F41A 11/02* (2006.01)
*F41A 3/66* (2006.01)

(52) U.S. Cl.
CPC ..... *F41A 3/66* (2013.01); *F41A 11/02* (2013.01)

(58) Field of Classification Search
CPC ..... F41C 27/00; F41A 11/00; F41A 11/02; F41A 5/18; F41A 5/26; F41A 5/28; F41A 21/00; F41A 21/48
USPC ..... 42/75.01, 75.02, 75.04; 89/128, 89/191.01–193
See application file for complete search history.

(56) References Cited

U.S. PATENT DOCUMENTS 6,293,040 B1 * 9/2001 Luth ..... F41A 11/02 42/75.01
7,131,228 B2 11/2006 Hochstrate et al.
7,444,775 B1 11/2008 Schuetz
2006/0026883 A1 * 2/2006 Hochstrate ..... F41C 23/16 42/75.01
2006/0283067 A1 * 12/2006 Herring ..... F41A 3/66 42/75.01
2007/0033851 A1 * 2/2007 Hochstrate ..... F41A 5/18 42/75.01

(Continued)

OTHER PUBLICATIONS

Olympic Arms Owner's Association, The Olympic Arms MPR15-308, Dec. 8, 2016, <http://www.oa2.org/Forum/viewtopic.php?f=67&t=15272>, all pages.*

*Primary Examiner* — Jonathan C Weber

(57) ABSTRACT

The disclosure describes a convertible lower receiver. The convertible lower receiver includes a first forward pivot assembly and a second forward pivot assembly. The first forward pivot assembly is associated with a first forward pivot receptacle that is designed to mate with a first type of upper receiver when a forward takedown pin is inserted through the first forward pivot receptacle and a forward lug of the first type of upper receiver. The second forward pivot assembly is associated with a second forward pivot receptacle that is designed to mate with a second type of upper receiver when the forward takedown pin is inserted through the second forward pivot receptacle and a forward lug of the second type of upper receiver. The convertible lower receiver further includes a multi-configuration magazine well that is configured to accept a first magazine associated with the first type of upper receiver when the first type of upper receiver is mated and to accept a second magazine associated with the second type of upper receiver when the second type of upper receiver is mated.

13 Claims, 11 Drawing Sheets

(56) References Cited

U.S. PATENT DOCUMENTS

| | | | | |
|---|---|---|---|---|
| 2007/0199435 | A1* | 8/2007 | Hochstrate | F41A 3/66 89/191.02 |
| 2010/0229445 | A1* | 9/2010 | Patel | F41A 3/66 42/6 |
| 2012/0167433 | A1 | 7/2012 | Robbins et al. | |
| 2012/0297656 | A1* | 11/2012 | Langevin | F41A 3/66 42/16 |
| 2014/0331535 | A1 | 11/2014 | Robinson et al. | |
| 2016/0161201 | A1* | 6/2016 | Langevin | F41A 3/66 42/75.02 |

* cited by examiner

CONVERTIBLE LOWER RECEIVER

CROSS REFERENCE TO RELATED APPLICATION

This application claims the benefit of U.S. Provisional Application No. 62/105,451, filed Jan. 20, 2015, which is incorporated in its entirety herein.

BACKGROUND

Gun enthusiasts enjoy being able to shoot different rounds. Typically, this requires purchasing a firearm for each desired round type if firearms are only capable of firing a fixed round. However, having separate firearms is very expensive and becomes cumbersome when shooting different rounds. Therefore, the gun industry has moved towards modularization of firearms. For example, U.S. patent application Ser. No. 2012/0167433 discloses a modular automatic or semi-automatic rifle that includes a lower receiver configured to mate with a 7.62 mm NATO compatible upper receiver and to mate with a 5.56 NATO type upper receiver via either an interface adaptor inserted via a top of the lower receiver in a magazine well or alternatively, via an integral adapter mounted or assembled to a frame of an upper receiver. These adaptors are required in order to convert between the two different rounds. While this modularization of firearms allows shooting different rounds, it requires additional external parts that add complexity to the reconfiguration, increases the risk of loss parts, and increases the amount of equipment required.

The present invention is directed at a convertible lower receiver that requires no additional external parts when configuring from one round to another.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
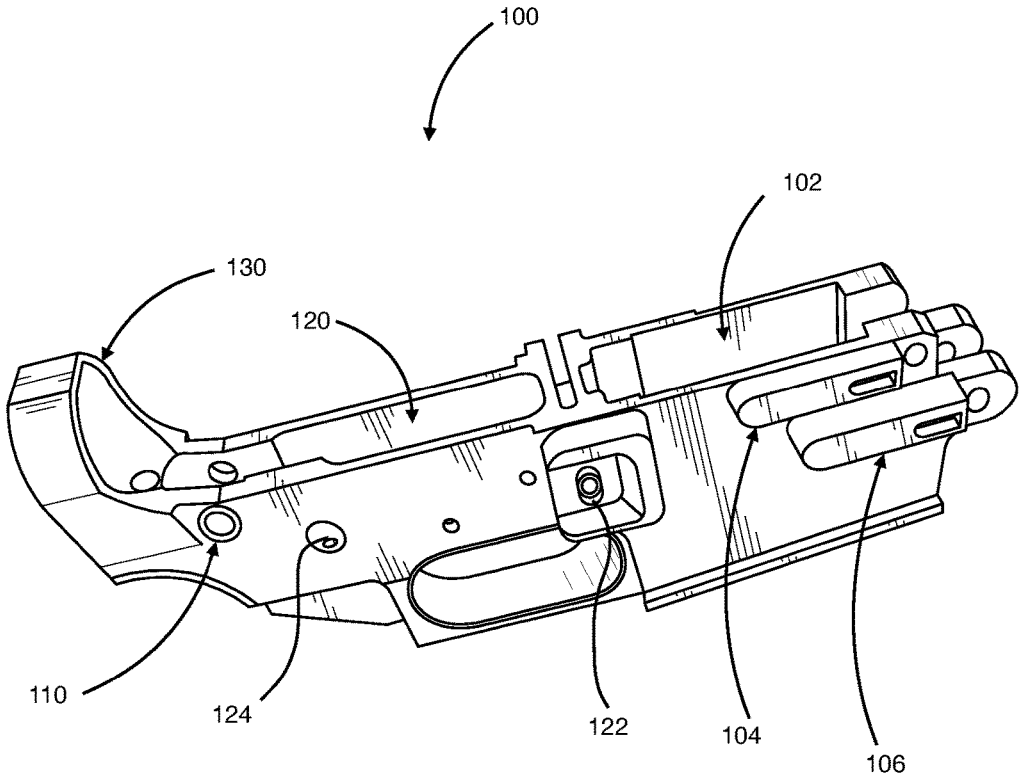
FIG. 1 is a perspective view of one embodiment of a convertible lower receiver in accordance with the principles of the present invention.

The following disclosure describes a convertible lower receiver that provides the ability to switch from one type of upper receiver to another type of upper receiver without the addition or removal of any adaptor. Although the features of such embodiments will be described with reference to the embodiments shown in the drawings, it should be understood that the described features can be embodied in many alternate forms of embodiments. In addition, any suitable size, shape or type of elements or materials could be used to achieve the desired inventive aspects of the present convertible lower receiver.

FIG. 1 is a perspective view of one embodiment of a convertible lower receiver in accordance with the principles of the present invention. In some embodiments, the convertible lower receiver 100 can be formed from a single billet of aluminum that is machined into a desired shape and size. In other embodiments, the convertible lower receiver 100 may be formed of cast aluminum or may be forged as a single piece. One skilled in the art will appreciate the advantages and disadvantages of each manufacturing method. In the described embodiment, the first type of upper receiver is compatible with an AR-15 type upper receiver. Those skilled in the art recognize that AR-15 compatible upper receivers are available in several caliber options and mate with any standard AR-15 compatible lower receiver. The second type of upper receiver refers to an upper receiver capable of firing a 7.62 mm NATO round, commercially know as a .308 caliber round. Throughout this specification a first type of upper receiver may be referred to as a 5.56 mm upper and the second type of upper may be referred to as a .308 upper. However, one skilled in the art will appreciate and understand that both the first type and second type of upper receiver may be configured for various caliber options and that the described features can be embodied in many alternate forms.

The convertible lower receiver 100 includes a multi-configuration magazine well 102, a first forward pivot assembly 104, a second forward pivot assembly 106, and a forward takedown pin (not shown). In addition, convertible lower receiver 100 includes other components compatible with a standard AR-15 type of lower receiver. Because the operation of the standard AR-15 type components is well know, the standard AR-15 type components will be discussed only as needed to describe the operation of the present invention. In the embodiment of the convertible lower receiver 100 shown in FIG. 1, the components of the convertible lower receiver 100 to the rear of the multi-configuration magazine well 102 may be components found on standard AR-15 type of lower receivers. For example, convertible lower receiver 100 includes a firearm assembly opening 120, a magazine release opening 122, and a safety opening 124. The firearm assembly opening 120 accepts any standard commercially available firearm assembly conforming to the GI-spec "small pin" standard (e.g., .155") for components compatible with a AR-15 type lower receiver. As those skilled in the art recognize, the firearm assembly includes a trigger and hammer. The convertible lower receiver 100 also includes a rear takedown receptacle 110 extending through to both sides of the convertible lower receiver 100. A rear takedown pin (not shown) is inserted for mating the lower convertible receiver 100 with an upper receiver. The convertible lower receiver 100 also includes a stock extension 130 that is threaded in a manner for a buttstock assembly to attach. In some embodiments, the stock extension 130 is configured to accept any standard commercially available A2 style buttstock assembly.

As will be described in greater detail below, the convertible lower receiver 100 is designed to accept any standard AR-15 compatible upper receiver and associated caliber options and any standard AR-15 compatible magazine associated with the caliber of the upper receiver. In addition, the convertible lower receiver 100 is designed to accept a .308 upper receiver and a .308 magazine for various caliber options. The .308 magazine may have a unique magazine design for each different caliber option or may use the same magazine design for multiple calibers. Importantly, the convertible lower receiver 100 allows conversion from any standard AR-15 compatible upper receiver to the .308 upper receiver with minimal effort and without any additional components and/or adaptors.

Figure 2A:
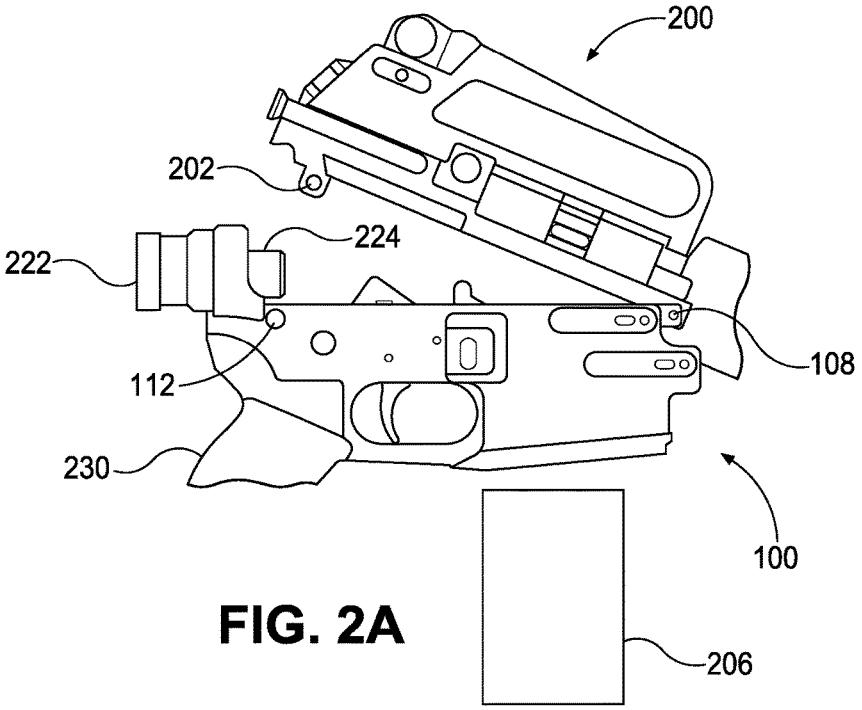
FIGS. 2A and 2B illustrate the convertible lower receiver shown in FIG. 1 being assembled with a first type of upper receiver and second type of upper receiver, respectively, without any additional parts.
Figure 2B:
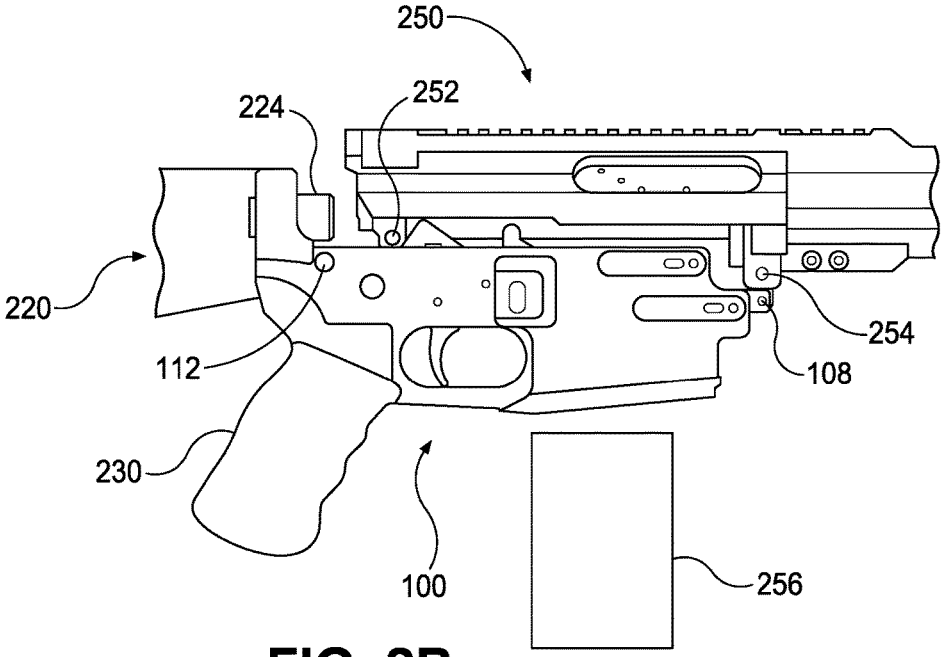

FIGS. 2A and 2B illustrate the convertible lower receiver shown in FIG. 1 being assembled with a first type of upper receiver and second type of upper receiver, respectively, without any additional parts. In FIG. 2A, convertible lower receiver 100 is illustrated with a first type of upper receiver 200 having a standard rear lug 202 and a standard forward lug (not shown). The convertible lower receiver is mated with the upper receiver 200 by inserting the rear takedown pin 112 through the rear takedown receptacle (rear takedown receptacle 110 shown in FIG. 1) and rear lug 202. In addition, the convertible lower receiver is mated with the upper receiver 200 by inserting the forward takedown pin 108 through the first forward pivot receptacle, described in more detail in FIGS. 3 and 9, and the forward lug of upper receiver 200. Magazine 206 associated with the first type of upper receiver 200 can be inserted into the multi-configuration magazine well of the convertible lower receiver. In addition, convertible lower receiver is illustrated with a commercially available firearm assembly inserted into the firearm assembly opening, a grip 230, and a portion of a buttstock assembly 222 including a buffer 224.

In FIG. 2B, convertible lower receiver 100 is illustrated with a second type of upper receiver 250 having a rear lug 252 and a forward lug 254. The convertible lower receiver is mated with upper receiver 250 by inserting the rear takedown pin 112 through the rear takedown receptacle (rear takedown receptacle 110 shown in FIG. 1) and rear lug 252. In addition, the convertible lower receiver is mated with upper receiver 250 by inserting the forward takedown pin 108 through the second forward pivot receptacle and the forward lug 254 of upper receiver 250. Second receiver magazine 256 associated with the second type of upper receiver 250 can be inserted into the multi-configuration magazine well of the convertible lower receiver 100. As shown in FIGS. 2A and 2B, multi-configuration magazine well is designed in such a manner that both standard AR-15 type magazines of various calibers and a second receiver magazine 256 associated with a second type of upper receiver fit within the same well without any blocks or fillers. Both types of magazines fit with the same firm stable fit without any wobble. Again, convertible lower receiver 100 is illustrated with a commercially available firearm assembly inserted into the firearm assembly opening, a grip 230, and a buttstock assembly 220 including a buffer 224. In addition, the second type of upper receiver 250 is designed in a manner such that the forward lug mates with a second pivot receptacle that is lower and more forward than the forward lug on the first type of upper receiver 200.

Figure 3:
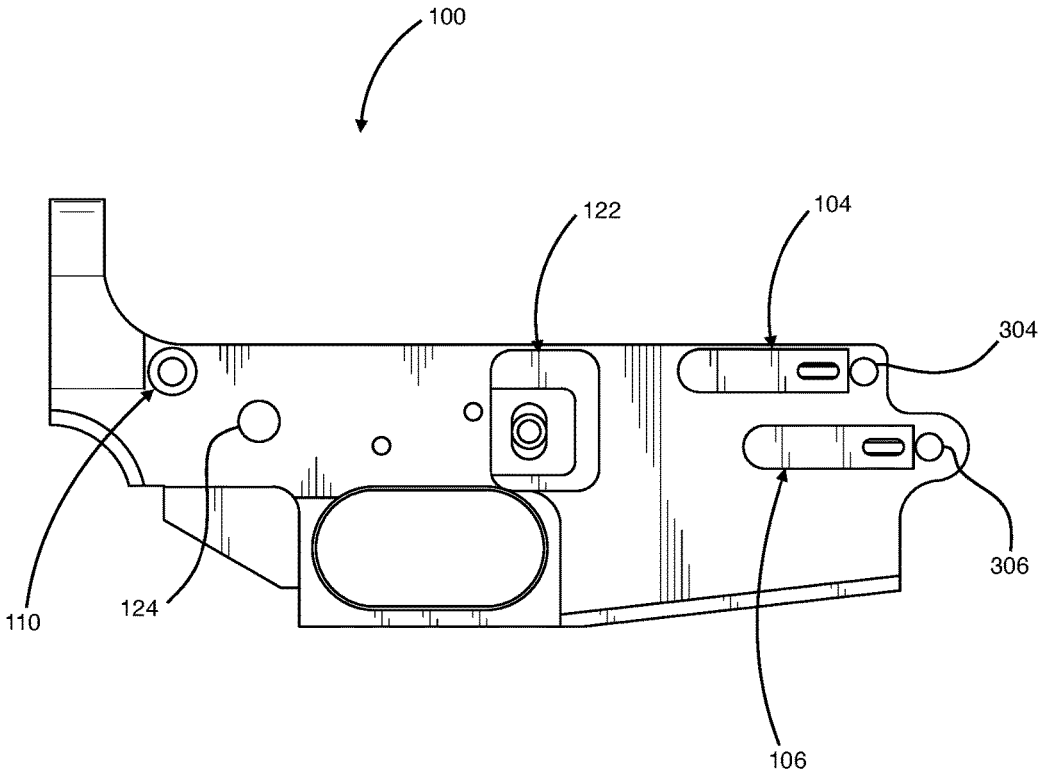
FIG. 3 is a right side view of one embodiment of the convertible lower receiver shown in FIG. 1.
Figure 9:
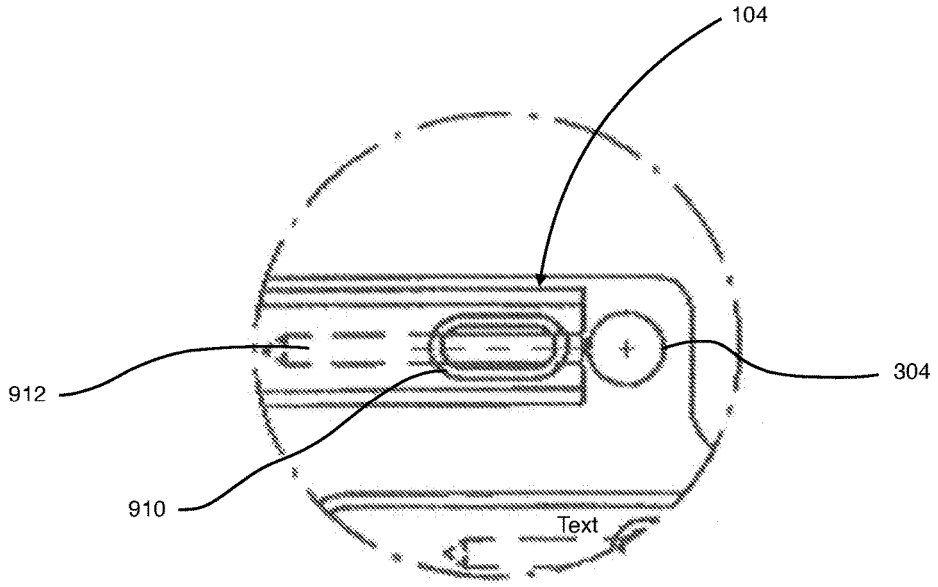
FIG. 9 is a more detailed view of one embodiment for the first forward pivot assembly of the convertible lower receiver shown in FIG. 3.

FIG. 3 is a right side view of one embodiment of the convertible lower receiver shown in FIG. 1. As mentioned earlier, the components in the rear up to, but not including, the multi-configuration magazine well, may be standard components found on AR-15 compatible lower receivers. However, the multi-configuration magazine well and the first and second forward pivot assemblies 104 and 106 are new features designed for the convertible lower receiver of the present application. The convertible lower receiver 100 includes the first forward pivot assembly 104 and the second forward pivot assembly 106. In some embodiments, the first forward pivot assembly 104 and the second forward pivot assembly 106 are designed with the same mechanism. However, different mechanisms may be used without departing from the scope of the claims in present application. One embodiment for an exemplary pivot assembly is illustrated in FIG. 9 and will be described in conjunction therein. The second forward pivot assembly 106 is positioned more forwardly than the first forward pivot assembly 104 and located lower on the convertible lower receiver than the first forward pivot assembly 104. The first and second pivot assembly 104, 106 include a respective first and second position opening 304, 306. The position of the first and second position openings 304, 306 are located in a manner to mate with a forward lug corresponding to the first and second type of upper receiver, respectively. As discussed above, convertible lower receiver 100 includes a firearm assembly opening 120, a magazine release opening 122, and a safety opening 124 into which commercially available AR-15 compatible components may be installed using conventional methods.

Figure 4:
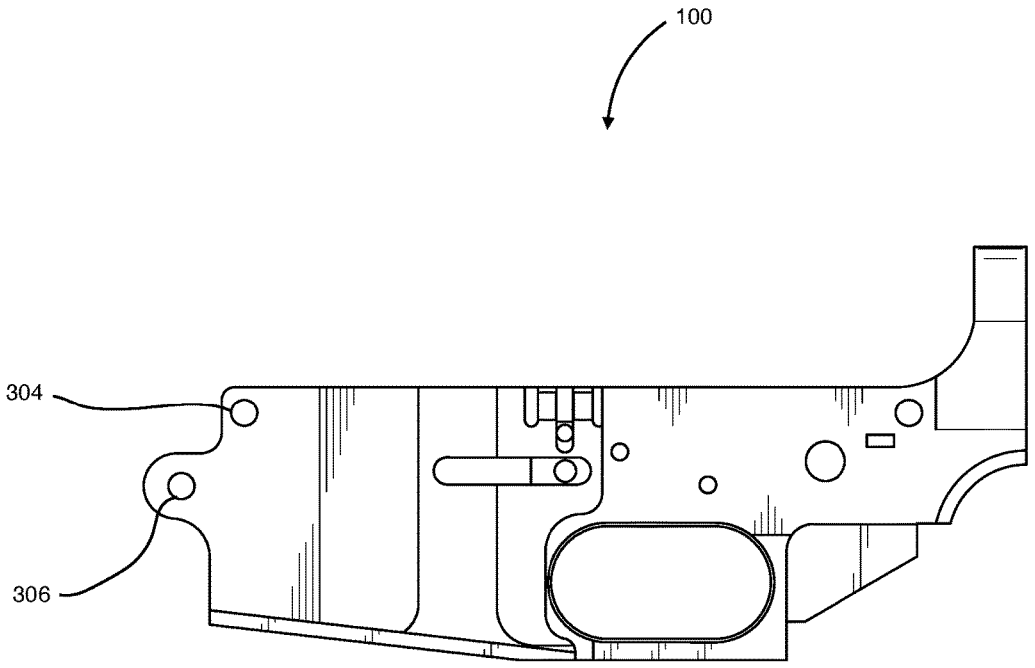
FIG. 4 is a left side view of one embodiment of the convertible lower receiver shown in FIG. 1.

FIG. 4 is a left side view of one embodiment of the convertible lower receiver shown in FIG. 1. As shown, the second forward pivot receptacle 306 is positioned more forwardly than the first forward pivot receptacle 304 and is located lower than the first forward pivot receptacle 304. In some embodiments, the center of the second forward pivot receptacle 306 may be 0.700 inches lower and 0.600 inches forward from the center of the first forward pivot receptacle 304. It is envisioned that other placements of the second forward pivot assembly and corresponding receptacle may be used that still allow proper operation of multiple magazines in the multi-configuration magazine well.

Figure 5:
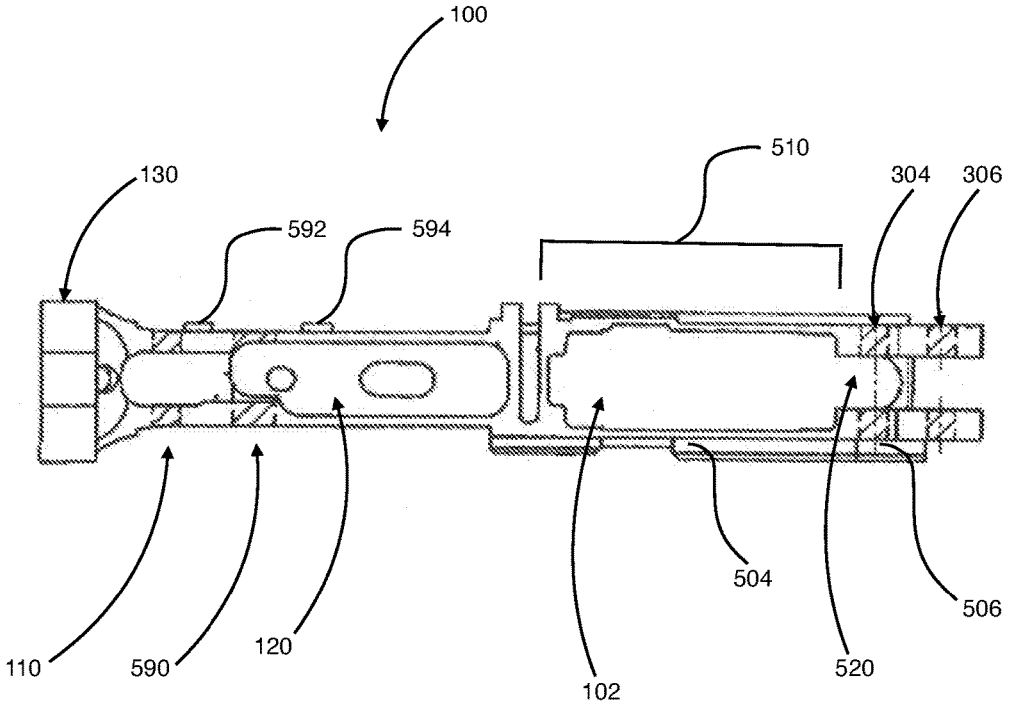
FIG. 5 is a top view of one embodiment of the convertible lower receiver shown in FIG. 1.

FIG. 5 is a top view of one embodiment of the convertible lower receiver shown in FIG. 1. Convertible lower receiver 100 is shown having standard AR-15 compatible components, such as a firearm assembly opening 120, a stock extension 130, a rear takedown receptacle 110, a safety assembly opening 590, safety bumpers 592, 594. In addition, in accordance with the present invention, convertible lower receiver 100 includes a multi-configuration magazine well 102, the first forward pivot receptacle 304, and the second forward pivot receptacle 306. Protruding from the right side of the convertible lower receiver 102, the top 504 of the first forward pivot assembly and the top 506 of the second forward pivot assembly is shown. The operation of the first and second forward pivot assembly will be described in more detail below in conjunction with FIG. 9. Multi-configuration magazine well 102 includes a first receiver magazine well 510 (denoted by a substantially rectangular shape).

In some embodiments, the first receiver magazine well 510 is dimensioned to accept a standard AR-15 compatible magazine. The multi-configuration magazine well 102 also includes a second receiver extension well 510 extending forwardly past the first forward pivot receptacle 304 but short of the second forward pivot receptacle 306. The second receiver extension well 520 is dimensioned in a manner such that the combined length of the first receiver magazine well and the second receiver extension well accommodate longer calibers than within the first receiver magazine well 510.

Figure 10:
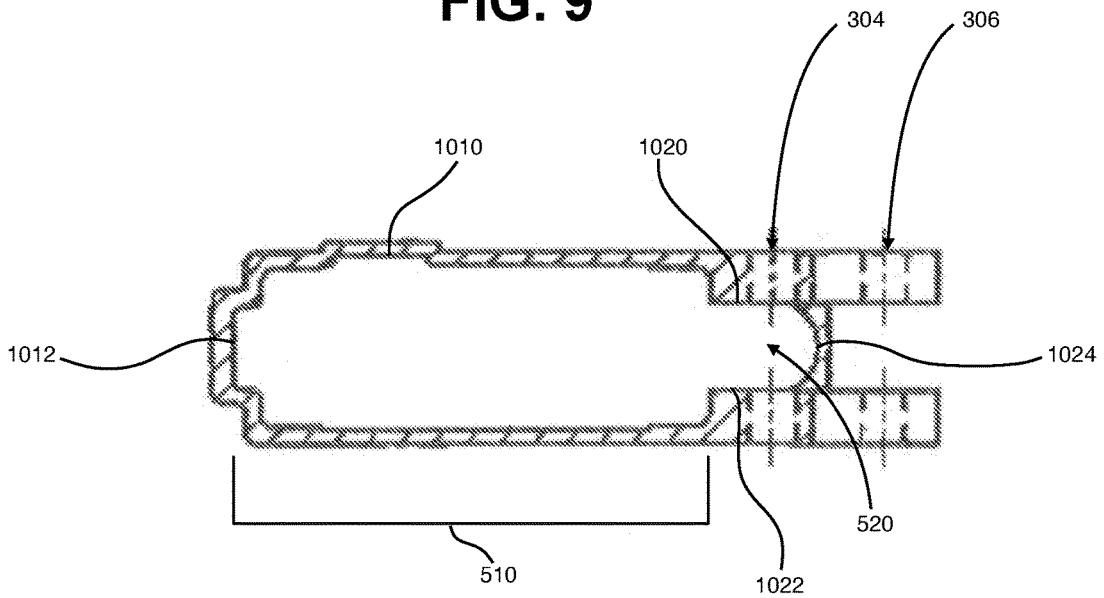
FIG. 10 is a more detailed view of one embodiment for the multi-configuration magazine well of the convertible lower receiver shown in FIG. 5.
Figure 11A:
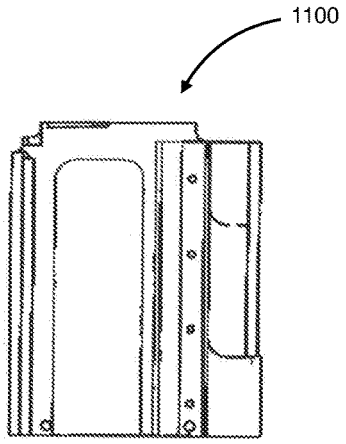
FIGS. 11A-11D are views of a magazine associated with a second type of upper receiver.
Figure 11C:
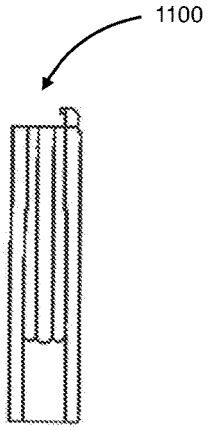
Figure 11B:
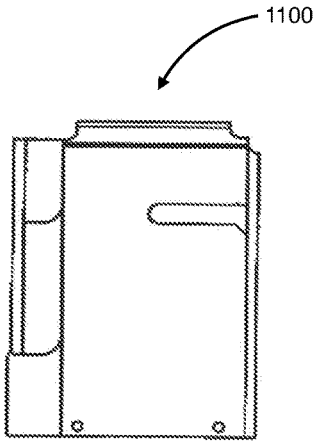
Figure 11D:
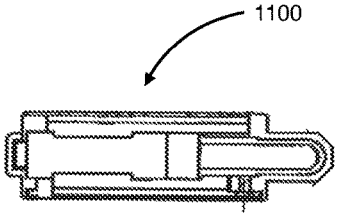

Turning now to FIG. 10 is a more detailed view of one embodiment of a multi-configuration magazine well of the convertible lower receiver shown in FIG. 5. As discussed above, multi-configuration magazine well 102 includes a first receiver magazine well 510 (denoted by a substantially rectangular shape). In some embodiments, the first receiver magazine well 510 is dimensioned to accept a standard AR-15 compatible magazine. The multi-configuration magazine well 102 also includes a second receiver extension well 520 extending forwardly past the first forward pivot receptacle 304 but short of the second forward pivot receptacle 306. The second receiver extension well 520 is dimensioned in a manner such that the combined length of the first receiver magazine well and the second receiver extension well accommodates a longer caliber than within the first receiver magazine well 510. In some embodiments, the second receiver extension well 510 extends approximately 0.589 in further forward than the first receiver magazine well and approximately 0.5 in wide centered with the first receiver magazine well. In some embodiments, the dimensions of the first receiver magazine well 510 is substantially 0.936 in by 2.566 in and has a slot 1010 that allows a tab of a standard AR-15 compatible magazine to pass without interference during insertion and removal of the magazine from the first receiver magazine well 510. The insertion and ejection of the first receiver magazine in the first receiver magazine well 510 operates using standard methods. FIGS. 11A-11D are views of one embodiment for a magazine 1100 associated with a second type of upper receiver. FIG. 11D illustrates an assembled view of the magazine. From this view, one can note that the magazine 1100 is shaped to conform to the multi-configuration magazine well and extends into the second receiver extension well in addition to the first receiver magazine well. This allows the magazine 1100 to accommodate longer rounds than the first receiver magazine well. The magazine 1100 is designed to operate within the convertible lower receiver in the same manner as a standard AR-15 compatible magazine, such as when the magazine is inserted into and/or released from the multi-configuration magazine well.

Figure 6:
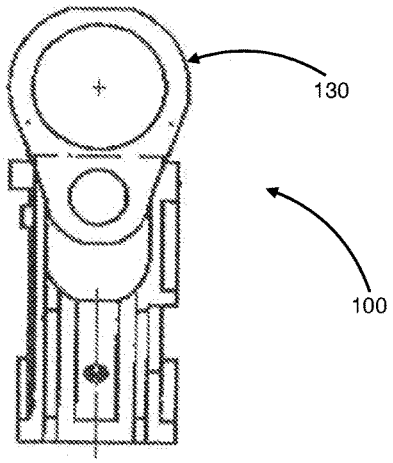
FIG. 6 is a back view of one embodiment of the convertible lower receiver shown in FIG. 1.
Figure 7:
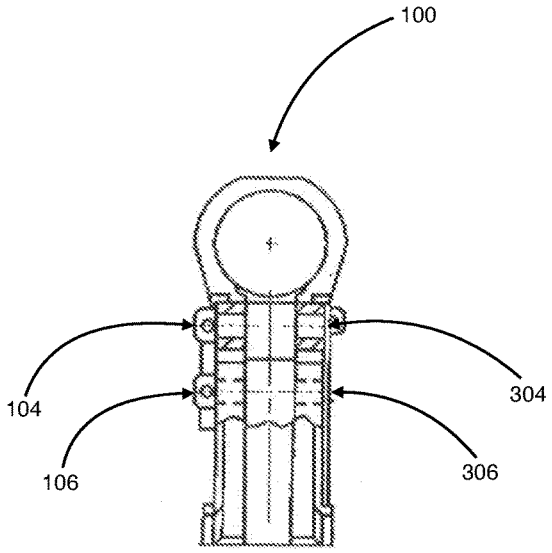
FIG. 7 is a front view of one embodiment of the convertible lower receive shown in FIG. 1.
Figure 8:
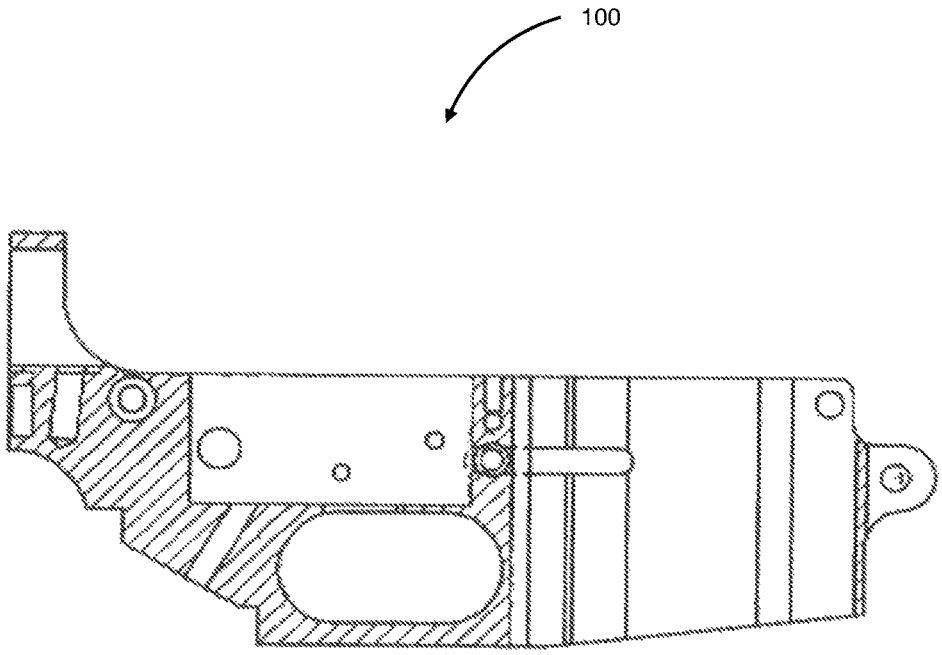
FIG. 8 is a cross-sectional view of the right side view shown in FIG. 3.

FIGS. 6 and 7 are a back and front view, respectively, of one embodiment of the convertible lower receiver shown in FIG. 1. The first and second forward pivot assemblies 104, 106 and their respective first and second forward pivot receptacles 304, 306 are illustrated. FIG. 8 is a cross-sectional view of the right side view shown in FIG. 3.

FIG. 9 is a more detailed view of one embodiment for the first forward pivot assembly of the convertible lower receiver shown in FIG. 3. The first forward pivot assembly 104 includes a first forward pivot receptacle 304, a takedown pin detent 910, a retainer track 912, and a spring (not shown). The takedown pin detent 910 is configured to slide along retainer track 912. In some embodiments, retainer track 912 is a groove within the first forward pivot assembly and the spring is placed within the retainer track 912 to the rear of the takedown pin detent 910. The takedown pin detent 910 is movable towards the rear to release the forward takedown pin. When the takedown pin detent 910 is in its stationary position, the detent 910 captures the forward takedown pin so that the pin does not fall out of the first forward pivot receptacle 304.

Figure 12A:
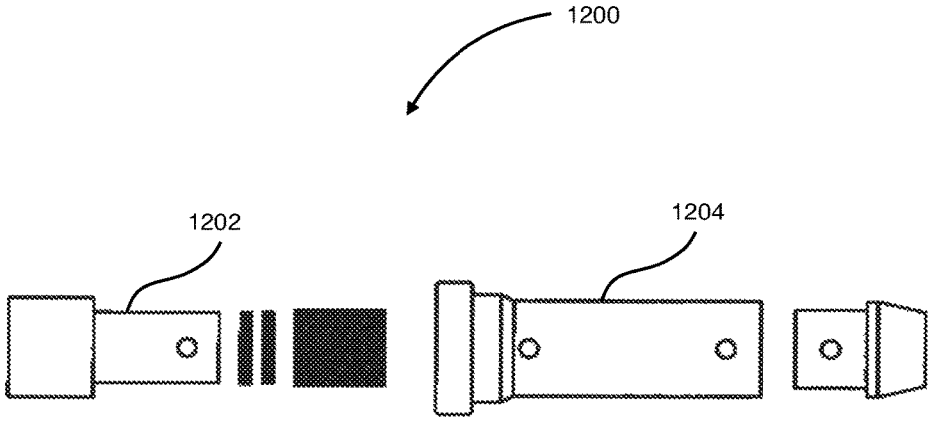
FIGS. 12A and 12B is an exploded view and an assembled view of one embodiment of a recoil buffer assembly that can be configured in conjunction with a buttstock assembly in the convertible lower receiver.
Figure 12B:
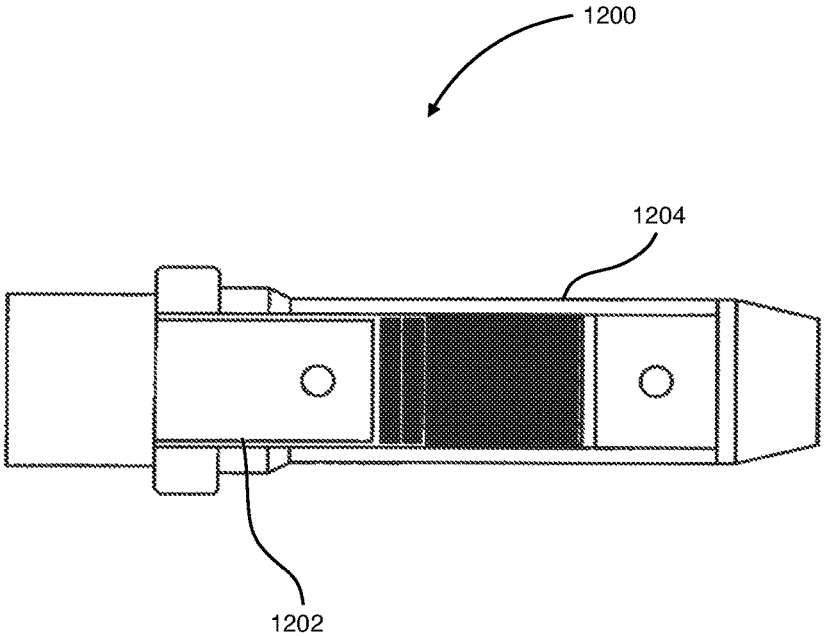
Figure 13A:
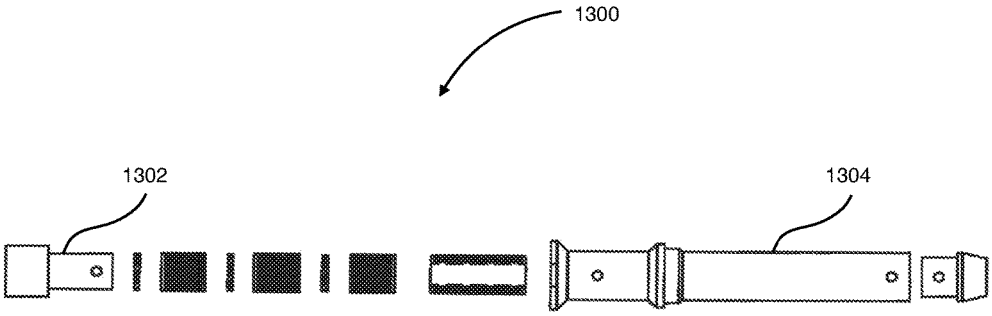
FIGS. 13A and 13B is an exploded view and an assembled view of another embodiment of a recoil buffer assembly that can be configured in conjunction with a buttstock assembly in the convertible lower receiver.
Figure 13B:
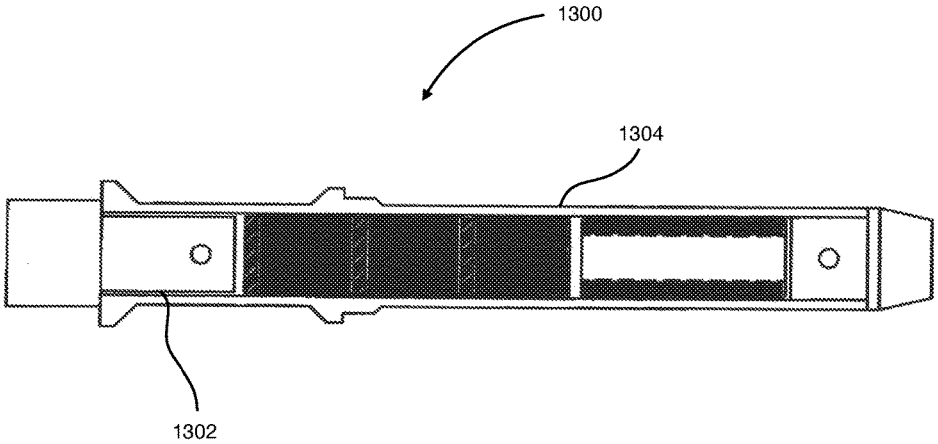

FIGS. 12A-12B and 13A-13B are some embodiments of a recoil buffer assembly that are capable of being implemented in conjunction with a buttstock assembly in the convertible lower receiver. FIGS. 12A and 13A are exploded views and FIGS. 12B and 13B are assembled views the two embodiments. In some embodiments, a steel extension 1202, 1302 replaces one of the weights. The steel extension 1202, 1302 is pinned into a respective body 1204, 1304 that may be shortened. Recoil buffer assembly 1200 may be used in conjunction with a collapsible stock version for an AR-15 style A2 buttstock, while the recoil buffer assembly 1300 may be used in conjunction with a standard AR-15 style A2 buttstock. Buffer assemblies 1200 and 1300 allow for a first style of upper receiver that is shorter than a second style of upper receiver to both be used on the convertible lower receiver without changing anything but the upper receiver and the corresponding magazine. The extension on the recoil buffer assembly sits on the back of a standard AR-15 bolt carrier when the upper receiver is in the convertible lower receiver. The extension fits inside the back of a 308 carrier assembly when it is on the convertible lower receiver.

Those skilled in the art will appreciate the features provided by the present convertible lower receiver. The present convertible lower receiver may be implemented for automatic or semi-automatic firearms. It will accept any standard AR-15 compatible upper receivers having various caliber options and their corresponding magazines. In addition, the convertible lower receiver accepts a second style of upper receiver supporting various caliber options. The dual forward pivot assemblies provide two positions for a front pivot pin and allow multiple styles of upper receiver to mate with the convertible lower receiver without the need for any adaptors or external modifications. While the convertible lower receiver is shown and described having two forward pivot assemblies, the convertible lower receiver could be designed with additional forward pivot assemblies to mate with additional styles of uppers.

While the foregoing written description of the invention enables one of ordinary skill to make and use a convertible lower receiver as described above, those of ordinary skill will understand and appreciate the existence of variations, combinations, and equivalents of the described embodiments, methods, and examples herein. Thus, the invention as claimed should therefore not be limited by the above described embodiments, methods, and examples, but by all embodiments and methods within the scope and spirit of the claimed invention.

The claimed invention is:

1. A lower firearm receiver, comprising:

a first forward pivot receptacle, the first forward pivot receptacle designed to mate with a first type of upper firearm receiver when a forward lug of the first type of upper firearm receiver is releasably engaged to the first forward pivot receptacle; and a second forward pivot receptacle, the second forward pivot receptacle designed to mate with a second type of upper firearm receiver when a forward lug of the second type of upper firearm receiver is releasably engaged to the second forward pivot receptacle.

2. The lower firearm receiver of claim 1, further comprising a multi-configuration magazine well configured to receive a first magazine associated with the first type of upper firearm receiver when the first type of upper firearm receiver is mated, and to accept a second magazine associated with the second type of upper firearm receiver when the second type of upper firearm receiver is mated, wherein the multi-configuration magazine is configured to receive the first magazine and the second magazine without use of an adaptor.

3. The lower firearm receiver of claim 2, wherein the multi-configuration magazine well comprises a magazine well and an extension well.

4. The lower firearm receiver of claim 3, wherein the second magazine is shaped to conform to both the magazine well and the extension well, and the first magazine is shaped to conform to the magazine well.

5. The lower firearm receiver of claim 1, wherein the first type of upper firearm receiver is configured to be releasably engaged using a first takedown pin.

6. The lower firearm receiver of claim 1, wherein the second type of upper firearm receiver is configured to be releasably engaged using a second takedown pin.

7. The lower firearm receiver of claim 5, wherein the first type of upper firearm receiver is configured to be releasably engaged using a first takedown pin and the second type of upper firearm receiver is configured to be releasably engaged using a second takedown pin, wherein the first takedown pin and the second takedown pin are the same.

8. The lower firearm receiver of claim 1, wherein the first type of upper firearm receiver, or the second type of upper firearm receiver, or both the first and second types of upper firearm receivers, are configured to be releasably engaged to the lower firearm receiver using a forward takedown pin.

9. The lower firearm receiver of claim 1, further comprising a first forward pivot assembly associated with the first forward pivot receptacle, wherein the first forward pivot assembly comprises a takedown pin detent and a retainer track.

10. The lower firearm receiver of claim 9, wherein a forward takedown pin releasably engages with the first forward pivot receptacle and wherein the takedown pin detent is configured to slide in the retainer track thereby releasing the forward takedown pin and capturing the forward takedown pin depending on a position of the takedown pin detent in the retainer track.

11. The lower firearm receiver of claim 1, wherein the lower firearm receiver comprises a forward end and a rearward end, and further wherein the second forward pivot receptacle is positioned more forward than the first forward pivot receptacle.

12. The lower firearm receiver of claim 1, wherein the lower firearm receiver comprises an upper portion and a lower portion, and further wherein the second forward pivot receptacle is positioned lower than the first forward pivot receptacle.

13. The lower firearm receiver of claim 1, wherein the lower firearm receiver comprises a forward end, a rearward end, an upper portion, and a lower portion, and further wherein the second forward pivot receptacle is positioned more forward and lower than the first forward pivot receptacle.

* * * * *